US005787546A

United States Patent [19]

Bass et al.

[11] Patent Number: 5,787,546

[45] Date of Patent: Aug. 4, 1998

[54] VACUUM CLEANER

[75] Inventors: Charles J. Bass, Somerville, Ala.; John W. Goodin, Coto De Caza; Mark W. LeBeau, Long Beach, both of Calif.; Carl E. Prindle, Boston, Mass.; William C. Tyler, Rainbow City, Ala.

[73] Assignee: Black & Decker Inc., Newark, Del.

[21] Appl. No.: 759,112

[22] Filed: Dec. 2, 1996

Related U.S. Application Data

[63] Continuation of Ser. No. 372,744, Jan. 13, 1995, abandoned.

[51] Int. Cl.[6] ..... A47L 5/24; A47L 5/26

[52] U.S. Cl. ..... 15/344; 15/334; 15/410

[58] Field of Search ..... 15/323, 331, 334, 15/344, 383, 410; 285/7, 903

[56] References Cited

U.S. PATENT DOCUMENTS

| | | | |
|---|---|---|---|
| 1,582,652 | 4/1926 | Albrecht . | |
| 1,936,761 | 11/1933 | Hoover . | |
| 2,166,863 | 7/1939 | Frame et al. . | |
| 2,210,950 | 8/1940 | Replogle . | |
| 2,227,971 | 1/1941 | Holm-Hansen . | |
| 2,287,922 | 6/1942 | White . | |
| 2,499,330 | 2/1950 | Reeves . | |
| 2,682,681 | 7/1954 | Balluff . | |
| 2,740,982 | 4/1956 | Brace . | |
| 3,167,330 | 1/1965 | Draudt | 285/903 |
| 3,667,084 | 6/1972 | Valbona et al. | 15/323 |
| 3,764,232 | 10/1973 | Brown . | |
| 3,892,003 | 7/1975 | Peabody . | |
| 4,175,352 | 11/1979 | Catlett | 15/344 |
| 4,519,113 | 5/1985 | Hipple . | |
| 4,662,027 | 5/1987 | Parker et al. . | |
| 4,688,833 | 8/1987 | Todd . | |
| 4,720,892 | 1/1988 | Parker et al. . | |
| 4,747,621 | 5/1988 | Gans et al. . | |
| 4,831,685 | 5/1989 | Bosyj et al. . | |
| 4,841,594 | 6/1989 | Elson et al. | 15/344 |
| 4,909,547 | 3/1990 | Guy . | |
| 4,918,781 | 4/1990 | Sovis et al. . | |
| 5,025,529 | 6/1991 | Hult et al. . | |
| 5,057,131 | 10/1991 | Lackner et al. . | |
| 5,129,128 | 7/1992 | Bowerman et al. . | |
| 5,129,684 | 7/1992 | Lawrence et al. . | |
| 5,134,751 | 8/1992 | Reed, Jr., et al. . | |
| 5,137,156 | 8/1992 | Riczinger et al. | 15/323 |
| 5,150,930 | 9/1992 | Petty et al. . | |
| 5,216,779 | 6/1993 | Glenn | 15/410 |
| 5,297,311 | 3/1994 | Puri . | |
| 5,331,716 | 7/1994 | Hemmann et al. . | |
| 5,351,996 | 10/1994 | Martin . | |

FOREIGN PATENT DOCUMENTS

| | | | |
|---|---|---|---|
| 2425227 | 1/1980 | France | 15/323 |
| 576561 | 12/1931 | Germany | 15/334 |
| 46067 | 7/1939 | Netherlands | 285/7 |
| 373072 | 5/1932 | United Kingdom . | |
| 1394497 | 5/1975 | United Kingdom | 15/334 |

*Primary Examiner*—Terrence Till

*Attorney, Agent, or Firm*—Bruce S. Shapiro; Dennis A. Dearing; John D. Del Ponti

[57] ABSTRACT

A vacuum cleaner 20 includes a housing 22 having a handle 208 and a brush compartment 82 for receipt of a brush assembly 104. A channel 210 is formed in the top of handle 208 and supports a hose 160 therein. A crevice tool 194 is coupled to hose 160 and is located in a continuation of channel 210 at a forward portion of housing 22. A forward portion of crevice tool 194 is located in a receptacle 100 formed in housing 22. A dust cup 52 is attachable to housing 22 and forms a dust collection chamber 47. When the vacuum cleaner 20 is operated in a brush mode, dirt-laden air is collected by operation of the brush assembly 104 over a surface being cleaned. In this mode, openings through crevice tool 194 and hose 160 serve as a conduit for the dirt-laden air to the dust collection chamber 47. Crevice tool 194 and hose 160 may be withdrawn from their nested position in channel 210 and vacuum cleaner 20 can be used in a hose mode where dirt-laden air is collected by passing the crevice tool over the surface to be cleaned.

13 Claims, 10 Drawing Sheets

160
229
225
208
210
50
44
27
45
22
60
46
52
26
24
80
70
76
78
48
83
83
82
104
132
55
82
86
122

20
160
229
225
208
210
192
218
188
180
294
182
184
196
226
22
194
72
52
198
74
220
93
94
92
80
48
76
78
70
83
83
89
89
120
82
84
104
284
106
282

VACUUM CLEANER

This application is a continuation of application Ser. No. 08/372,744, filed Jan. 13, 1995, now abandoned.

BACKGROUND OF THE INVENTION

This invention relates to a vacuum cleaner and, more particularly, relates to a hand-held vacuum cleaner usable in a brush mode or a hose mode.

Many of the present day hand-held vacuum cleaners are operable in either a corded mode or a cordless mode and include a housing which contains various functional components during operation of such cleaners. These components may include, but are not limited to, a motor, a brush, a drive linkage between the brush and the motor, and a dust collector. Such components also include a vacuum-developing system for drawing dust laden air from the area of the brush to the collector during operation of the vacuum cleaner in a brush mode. Some vacuum cleaners also include individual attachments which may be coupled to a hose which, in turn, is coupled to the housing for collecting dust laden air. The dust laden air is drawn to the dust collector by a vacuum developed through the attachments and the hose by the vacuum developing system during operation of the vacuum cleaner in a hose mode.

Typically, when such vacuum cleaners are not operated in the hose mode, the hose is stored separately from the vacuum cleaner or is stored in a generally concealed fashion within the housing provided there is sufficient space for such storage. In either instance, the storage facility of such vacuum cleaner hoses is inconvenient. Additionally, it is time consuming to locate, assemble and, ultimately, to disassemble the hose in conjunction with the use if such vacuum cleaners.

Thus, there is a need for a vacuum cleaner having a housing which facilitates convenient and easy storage of a hose of the cleaner during non-use of the hose while, at the same time, providing ready access to the hose for use thereof in a hose mode.

When operating in a brush mode, vacuum cleaners of this type usually include a motor which supplies driving energy to a brush through a coupling belt. At times, the belt wears and must be replaced. In some vacuum cleaners of this type, the belt is mounted in a location which is difficult to access and thus requires a tedious and time-consuming effort to replace the worn belt.

Thus, there is a need for a belt mounting arrangement which is readily accessible for easy replacement.

In many vacuum cleaners of this type, the belt is looped about a pulley which is assembled with a roller or hub from which bristles of the brush extend to facilitate rotational drive to the brush. A brush assembly of vacuum cleaners of this type includes the brush and is normally mounted within a brush compartment of a housing of the vacuum cleaner. When the belt is to be replaced, the brush assembly must be removed from the brush compartment to facilitate assembly of the belt with the brush pulley whereafter the brush assembly is reinserted into the brush compartment. In some vacuum cleaners of this type, removal of the brush assembly from the brush compartment is a difficult and time consuming operation.

Thus, there is a need for complementary structure of a brush assembly and a brush compartment which facilitates easy and quick removal of the brush assembly from, and easy and quick insertion into, the brush compartment.

SUMMARY OF THE INVENTION

In view of the foregoing needs, it is an object of this invention to provide a vacuum cleaner having facility for the ready storage of a conduit, such as a hose, for use therewith.

Another object of this invention is to provide a housing for a hand-held vacuum cleaner which includes facility for manual handling of the cleaner when used in either a brush mode or a hose mode while providing convenient and accessible storage of a conduit, such as a hose.

Still another object of this invention is to provide a vacuum cleaner having a housing which provides facility for manually manipulating the cleaner during use in either a brush mode or a hose mode while providing facility for readily accessible storage of a conduit, such as a hose, externally of the housing.

It is another object of this invention to provide a vacuum cleaner having a belt mounting arrangement which is readily accessible for easy and quick removal of a belt from a housing of the cleaner.

Still, a further object of this invention is to provide a vacuum cleaner having a brush compartment and a brush assembly for assembly therein with the housing of the brush compartment and the brush assembly having complementary structure to facilitate the easy and quick removal of the brush assembly from, and insertion into, the brush compartment.

With these and other objects in mind, this invention contemplates a vacuum cleaner formed with a housing having an entry end through which dust laden air is initially drawn. A vacuum drawing and conveying system is mounted on the housing. The system includes a conduit having a first end and a second end spaced from the first end thereof with the first end attachable to the entry end externally of the housing and the second end thereof coupled to a portion of the housing at a location externally of the housing and spaced from the entry end. The housing is formed with a support structure for receiving the conduit between the first and second ends thereof.

This invention also contemplates a housing for a vacuum cleaner having a supporting structure located externally of the housing and formed in a shape for receipt of a hand of a user to facilitate the handling of the vacuum cleaner. This invention further contemplates a nest formed in the supporting structure for receipt of a component of the vacuum cleaner.

Other objects, features and advantages of the present invention will become more fully apparent from the following detailed description of the preferred embodiment, the appended claims and the accompanying drawings.

DETAILED DESCRIPTION OF THE PREFERRED EMBODIMENTS

Figure 1:
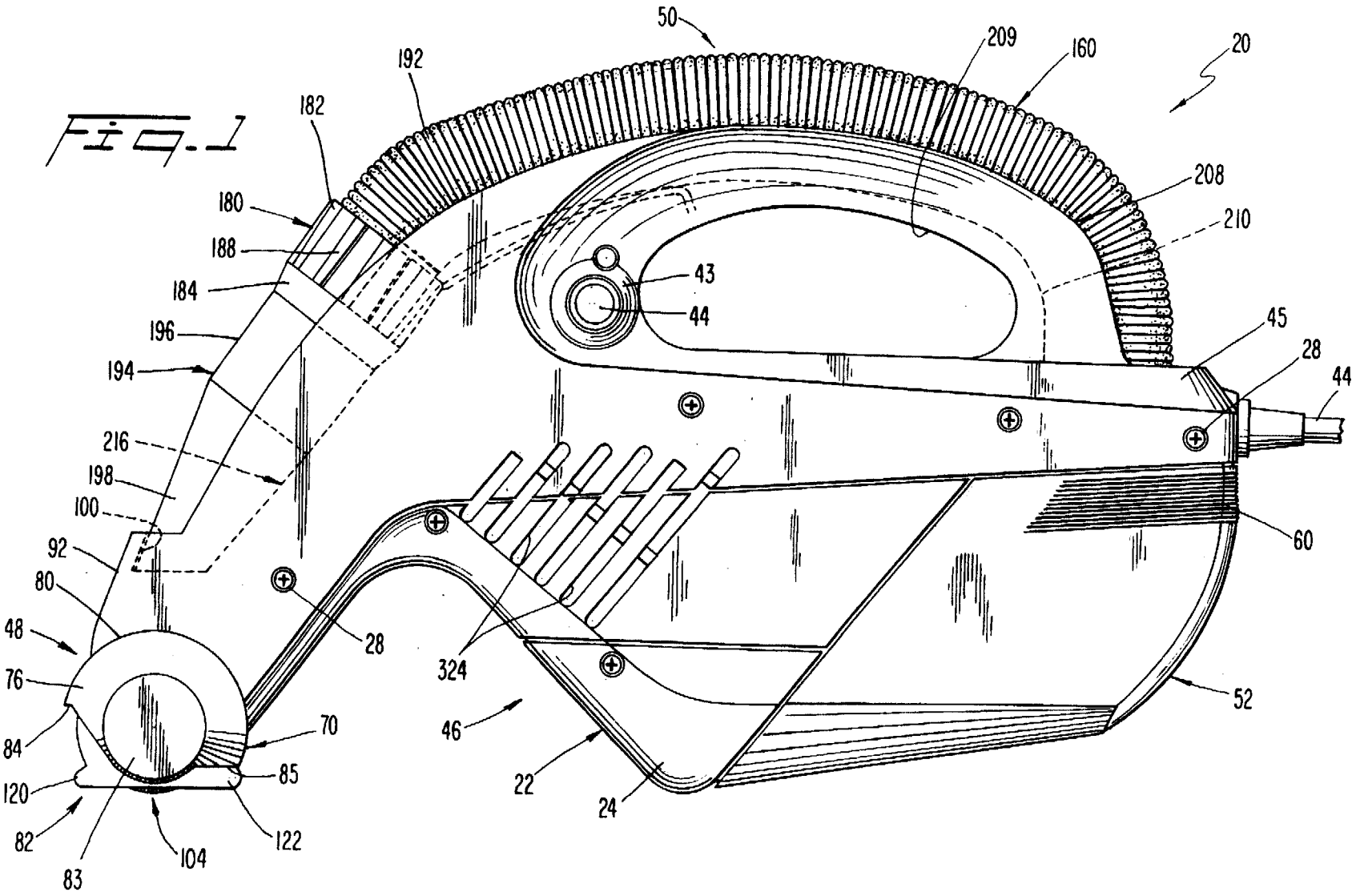
FIG. 1 is a side elevation view showing a vacuum cleaner having a hose nested in a handle in accordance with certain principles of the invention.

Referring to FIG. 1, a vacuum cleaner 20 includes a housing 22 formed by two generally clam shell half sections 24 and 26 (FIG. 3), each having an external configuration which is generally a mirror image of the other section. The clam shell sections 24 and 26 are joined along a seam line 27 (FIG. 3) and are secured together by a plurality of screws 28 to form a hollow space 29 (FIG. 15) within housing 22.

Figure 15:
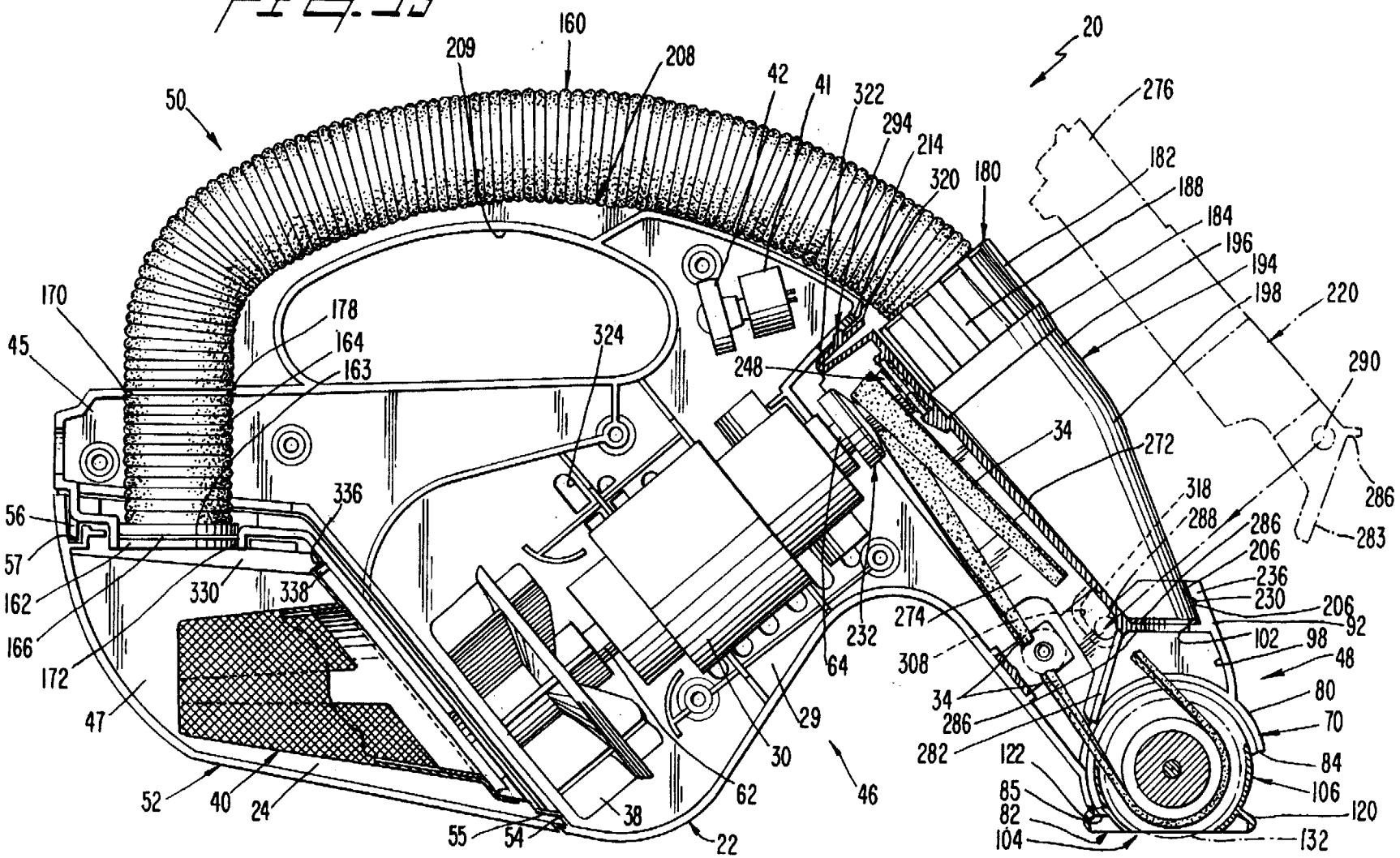
FIG. 15 is a side view showing a half shell of the housing being uncovered to reveal various components of the vacuum cleaner of FIG. 1 and the relative location of the components within the housing in accordance with certain principles of the invention.

As viewed in FIG. 15, a plurality of components of vacuum cleaner 20 are mounted within space 29 and supported by housing 22. These components include a motor 30, a drive belt 34, a brush assembly 104, a fan 38, a dust collector 40, an electrical switch 41 for the motor and a switch actuator 42. As shown in FIG. 1, a cord 44 is secured to a rear portion 45 of housing 22 and provides for the connecting of electrical operating energy to motor 30 from a conventional wall outlet source of energy (not shown). It is noted that vacuum cleaner 20 could be powered by other sources of energy, such as a battery (not shown), which can be located internally or externally of housing 22 without departing from the spirit and scope of the invention.

Referring to FIG. 1, housing 22 is composed generally of three sections which include a body section 46, a brush compartment section 48 and a support section 50. Body section 46 includes a dust cup 52 at the rear bottom thereof which defines a dust collection chamber 47 (FIG. 15). As shown in FIG. 15, dust collector 40 is removably located in cup 52 and is composed of a rib-supported fabric, paper or the like which typically allows drawn air to pass therethrough but prevents dirt, dust and debris from moving beyond chamber 47. Cup 52 is removable from housing 22 to facilitate removal of the collected dirt, dust and debris and for cleaning dust collector 40.

Figure 4:
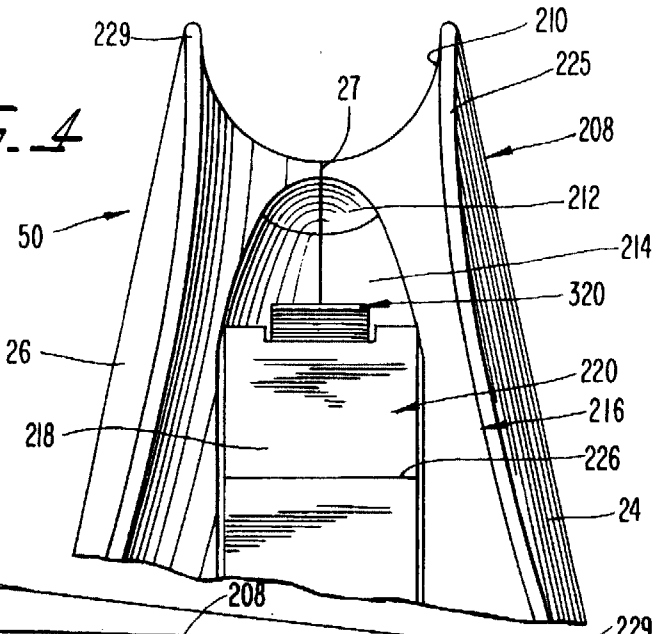
FIG. 4 is a partial front view of the housing of FIG. 1 showing a front portion of the handle.

As shown FIG. 1, support section 50 includes a handle 208 which extends from rear portion 45 of housing 22 and extends, in an arcing fashion, to a forward portion of the housing. An opening 209 is formed between handle 208 and body section 46 of housing 22 to provide for manual gripping of vacuum cleaner 20. Handle 208 is formed with a concave channel 210 (FIG. 4) which forms a U-shaped cradle for receipt of a flexible hose 160. Hose 160 extends from rear portion 45 of housing 22 adjacent a rear end of handle 208 and is nested in the cradle formed by the handle. A forward portion of hose 160 is coupled to a hose connector 180 which is coupled to a crevice tool 194.

Crevice tool 194 is located in a flat section 216 (FIG. 3) of housing 22 which is an extension of channel 210. A forward end of crevice tool 194 is inserted into a receptacle 100 (FIG. 2) located at the upper portion of brush compartment section 48. Brush assembly 104 is located within a shroud 70 of brush compartment section 48.

Figures 2, 22:
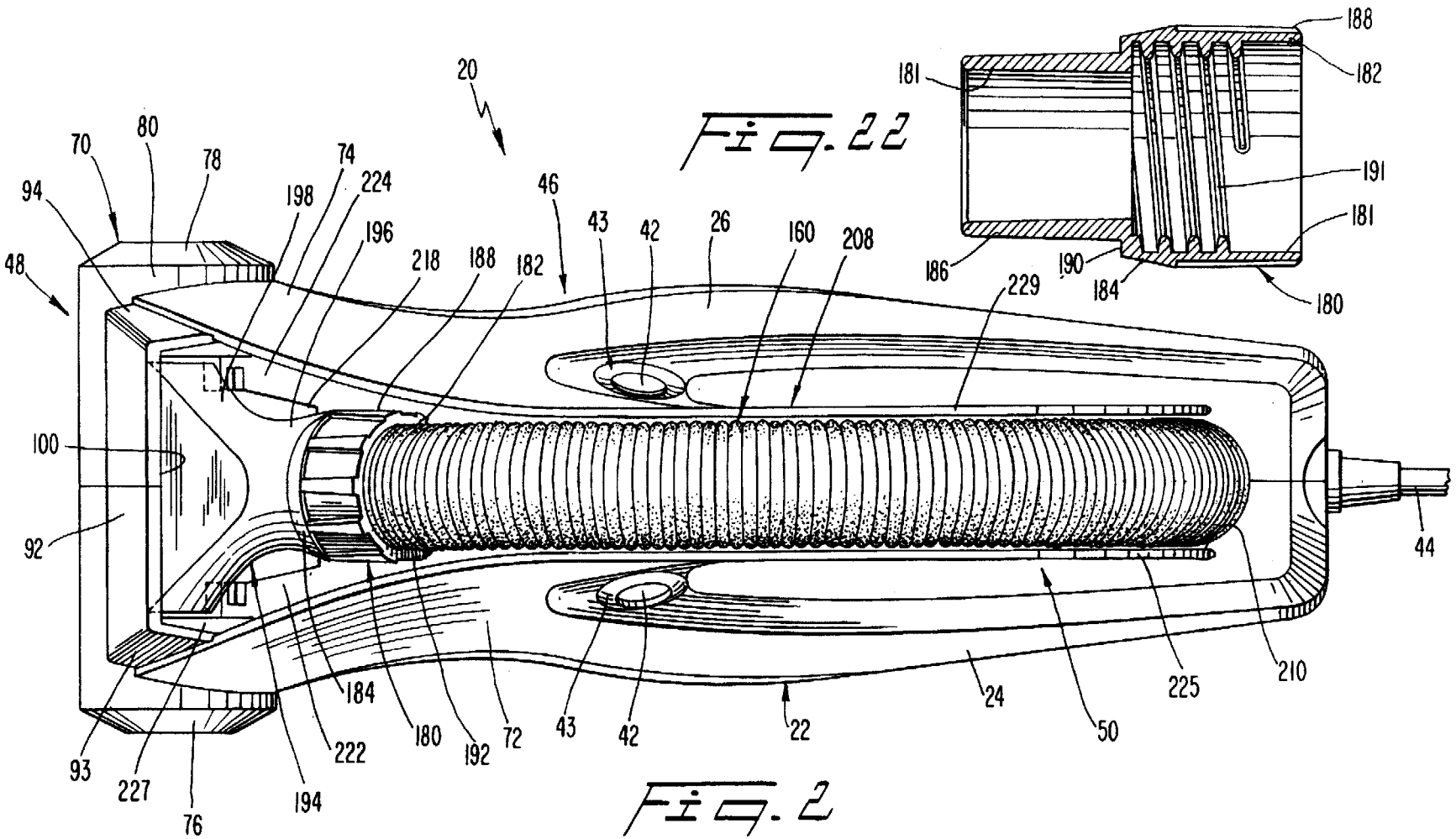
FIG. 2 is a top view of the vacuum cleaner of FIG. 1 showing the hose nested in the handle at the top of the housing in accordance with certain principles of the invention.
FIG. 22 is a sectional view of a hose connector which facilitates the coupling of the hose of FIG. 2 to the crevice tool of FIG. 11 in accordance with certain principles of the invention.
Figure 3:
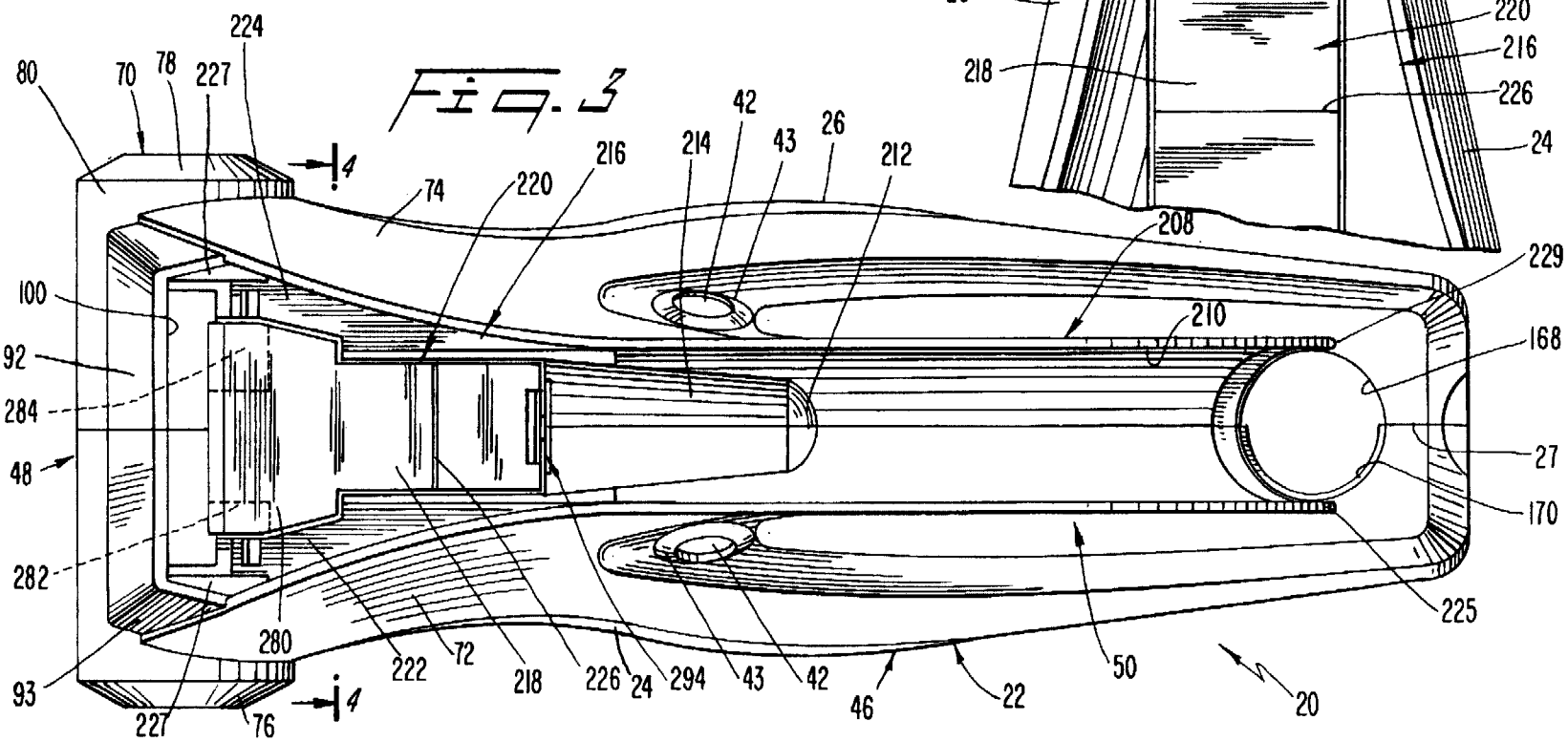
FIG. 3 is a top view of the housing of the vacuum cleaner of FIG. 1 showing the handle with the hose removed in accordance with certain principles of the invention.
Figure 5:
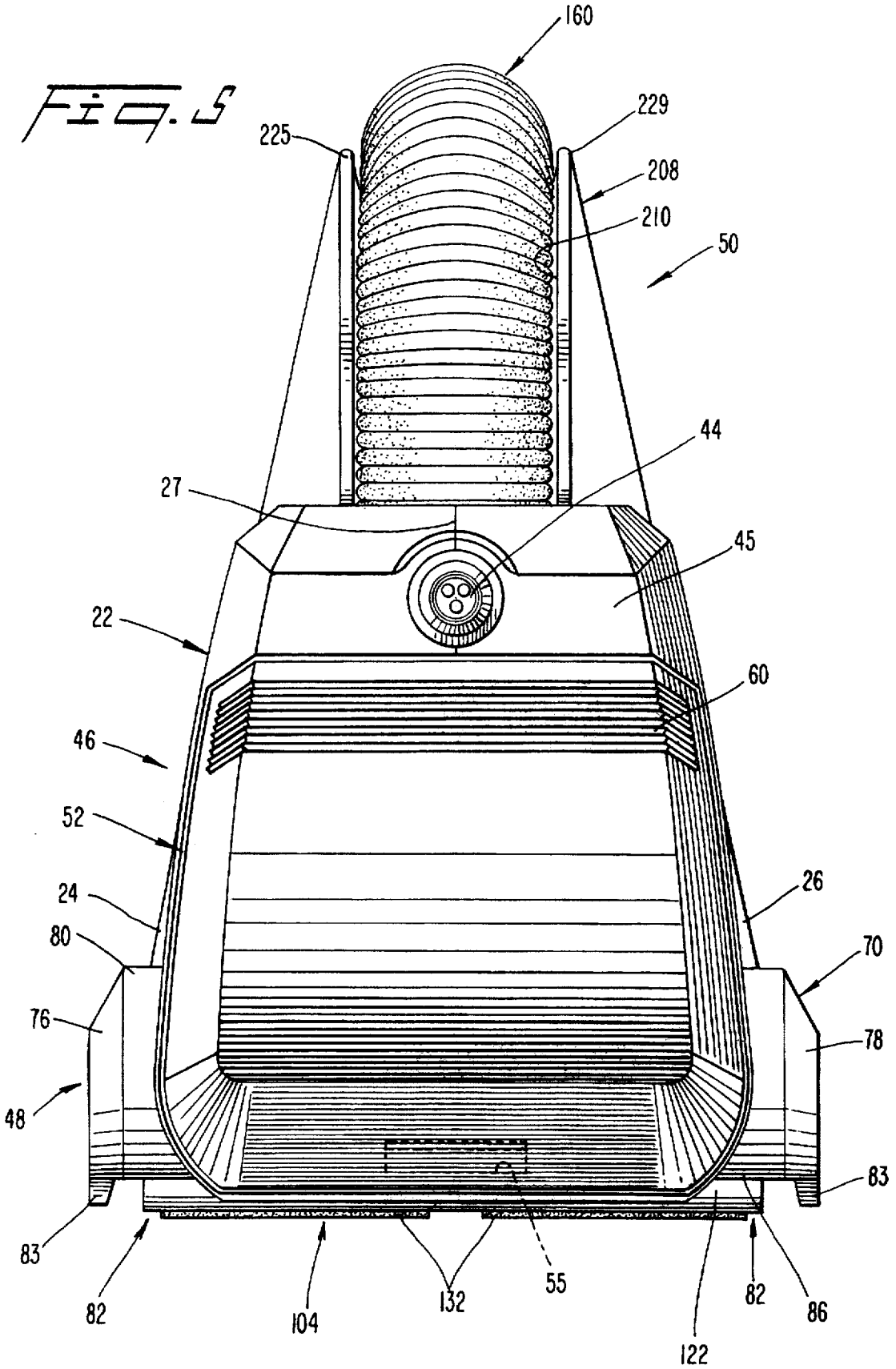
FIG. 5 is a rear view of the vacuum cleaner of FIG. 1 showing the hose nested in the handle in accordance with certain principles of the invention.

As shown in FIGS. 1, 2 and 3, a protective actuator guard 43 is formed on each of clam shell sections 24 and 26 and surrounds an associated opening in the respective clam shell section. The openings formed in clam shell sections 24 and 26 allow access to opposite ends of switch actuator 42 to facilitate manual sliding movement of the actuator from a deactuated position to an actuated position and vice-versa. The protective actuator guards 43 prevent unintentional actuation of switch 41 by requiring that switch actuator 42 be manually engaged through the respective openings as defined by the guards.

In operation of vacuum cleaner 20 in a brush mode, hose 160 and crevice tool 194 are assembled as shown in FIG. 1. Switch actuator 42 is depressed to operate motor 30 and brush assembly 104 is passed over a surface to be cleaned from which dirt-laden air is to be extracted. Upon operation of motor 30, a suction is created by fan 38 (FIG. 15) whereby the dirt-laden air is drawn through brush compartment section 48, through crevice tool 194, hose connector 180 and hose 160 and is deposited into chamber 47 (FIG. 15). In a hose mode of operating vacuum cleaner 20, crevice tool 194 and hose 160 are removed from flat section 216 (FIG. 3) and channel 210, respectively, and the crevice tool is moved over a surface to be cleaned to draw dirt-laden air through the crevice tool, the hose and into chamber 47 (FIG. 15).

During the brush mode, as well as during non-vacuuming transport of vacuum cleaner 20, the exposed portion of hose 160 above handle 208 serves as a manual gripping facility, together with the handle. This allows the user's fingers to be placed through handle opening 209 and over and around the exposed portion of hose 160 for increased stability and maneuverability of vacuum cleaner 20 during the brush mode and during non-vacuuming transport of the vacuum cleaner.

Figure 20:
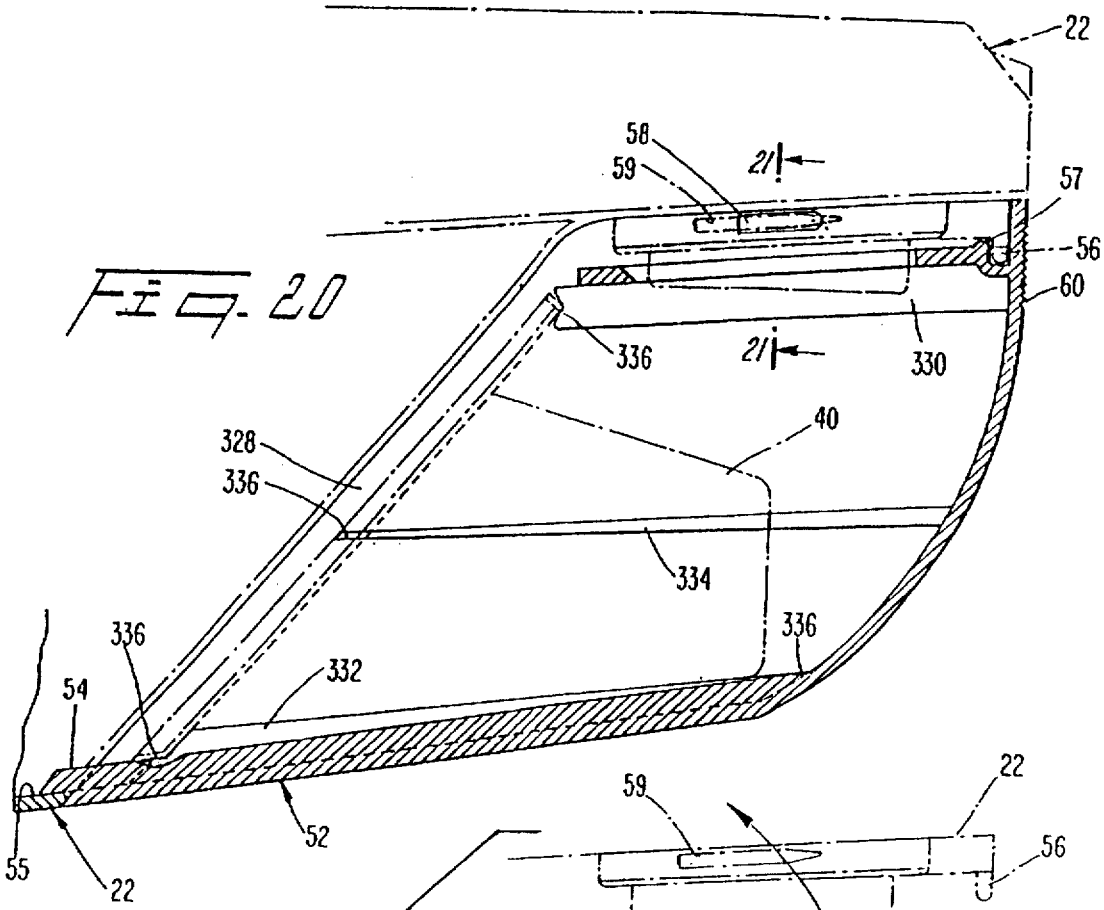
FIG. 20 is a partial side view showing the dust cup of FIG. 19 in a final assembly position with the housing.
Figure 19:
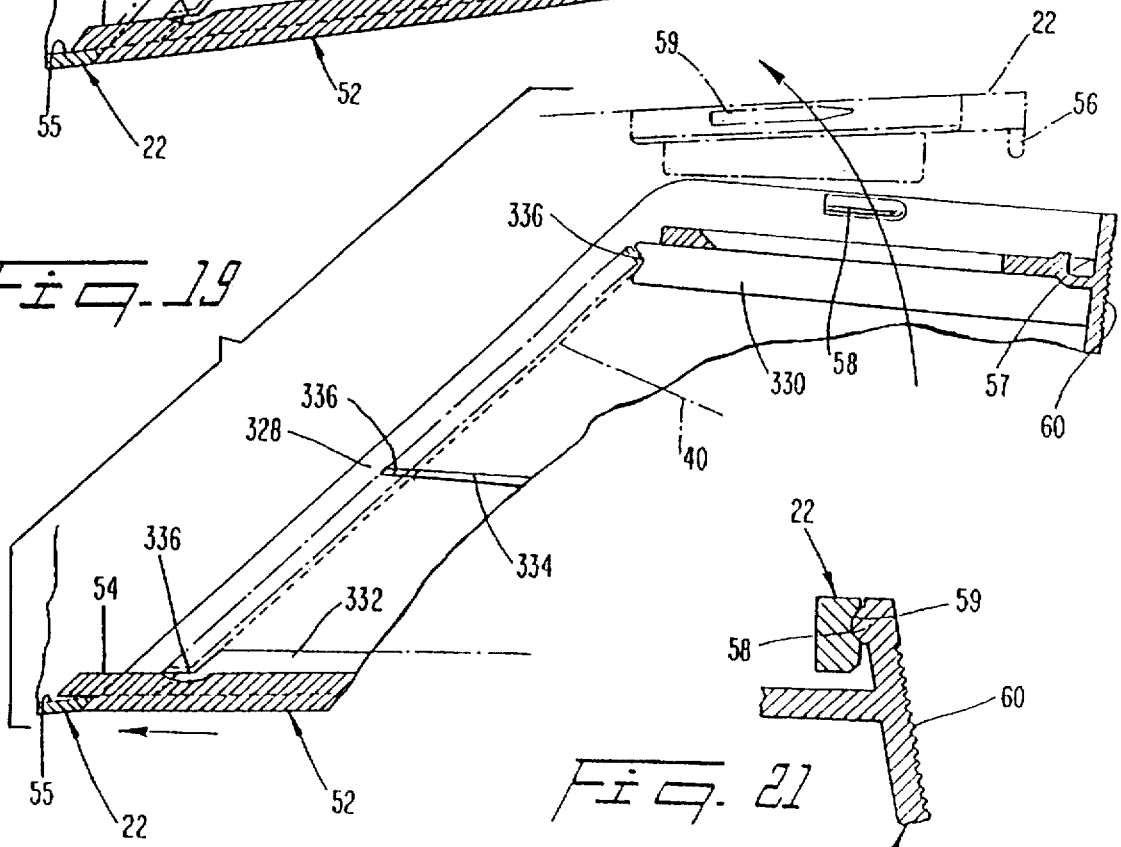
FIG. 19 is a partial side view showing the initial assembly position of a dust cup with the housing in accordance with certain principles of the invention.
Figure 21:
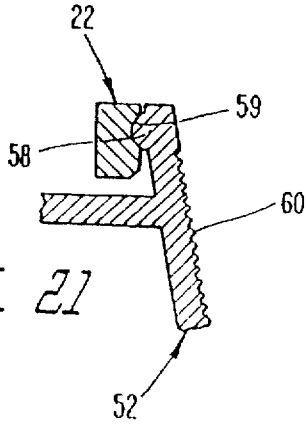
FIG. 21 is a partial side view of a securing feature for securing the dust cup of FIG. 19 with the housing in accordance with certain principles of the invention.

As viewed in FIGS. 15, 19 and 20 a projection 54 extends forwardly from the bottom front portion of cup 52 and is positionable onto a ledge 55 located at a bottom portion of housing 22. A rib 56 is formed in an undersurface at the rear of housing 22 and projects downwardly into a slot 57 formed in the upper rear portion of cup 52. As viewed in FIGS. 19, 20 and 21, a pair of bosses 58 (one shown) are formed on the inner surfaces of spaced side walls of dust cup 52 and extend toward each other and are located to seat in accommodating slots 59 formed in portions of housing 22 just forward of rib 56. As shown in FIG. 1, a plurality of striations 60 are formed on the outer surface of cup 52 at the rear and sides thereof to facilitate manual gripping of the cup during assembly and disassembly thereof.

As illustrated in FIGS. 19 and 20, cup 52 is essentially open at an inboard side 328 which is the side that faces fan 38 when the cup is assembled with housing 22 as shown in FIG. 15. As further shown in FIGS. 19 and 20, cup 52 is formed with a pair of spaced ribs 330 (one shown) in an upper wall thereof and a pair of spaced ribs 332 (one shown) in a lower wall thereof. Further, cup is formed with a rib 334 in one sidewall thereof and a comparable rib (not shown) in a sidewall thereof opposite the one sidewall. Each of the ribs 330, 332 and 334 are formed with a notch 336 which faces outwardly in the direction of side 328 of cup 352.

Referring to FIG. 15, dust collector 40 is assembled with cup 52 by first inserting the fabric covered section thereof into and through side 328 of the cup. Eventually, a flange or skirt 338 of dust collector 40 seats in notches 336 in a friction fit to complete the assembly of the duct collector with the cup.

Thereafter, cup 52 is gripped manually in the area of striations 60 whereafter projection 54 is positioned on ledge 55 while the cup is held at a downward angle, as shown in FIG. 19, with a pivot point for the cup being coincidental with the juncture of the projection and the slot. Cup 52 is then pivoted upwardly about the pivot point to the position shown in FIG. 20 whereby rib 56 is moved into slot 57 and, as shown in FIG. 22, bosses 58 are snapped into slots 59. Cup 52 is now removably retained with housing 22. To remove cup 52 from assembly with housing 22, striations 60 of the cup are gripped along the rear sides thereof and the cup is pulled downwardly whereby the downward force urges bosses 58 out of slots 59 to allow removal of the cup. It is noted that the components related to the securance of cup 52 with housing 22 are concealed and, thereby, are not visible from the exterior of vacuum cleaner 20.

Referring further to FIG. 15, a shaft 62 extends axially from one end of motor 30 and is coupled to fan 38 to facilitate the operation of the fan. A shaft 64 extends axially from-the opposite end of motor 30 and is coupled to a clutch hub 232 by a press fit for purposes to be described below.

Figure 6:
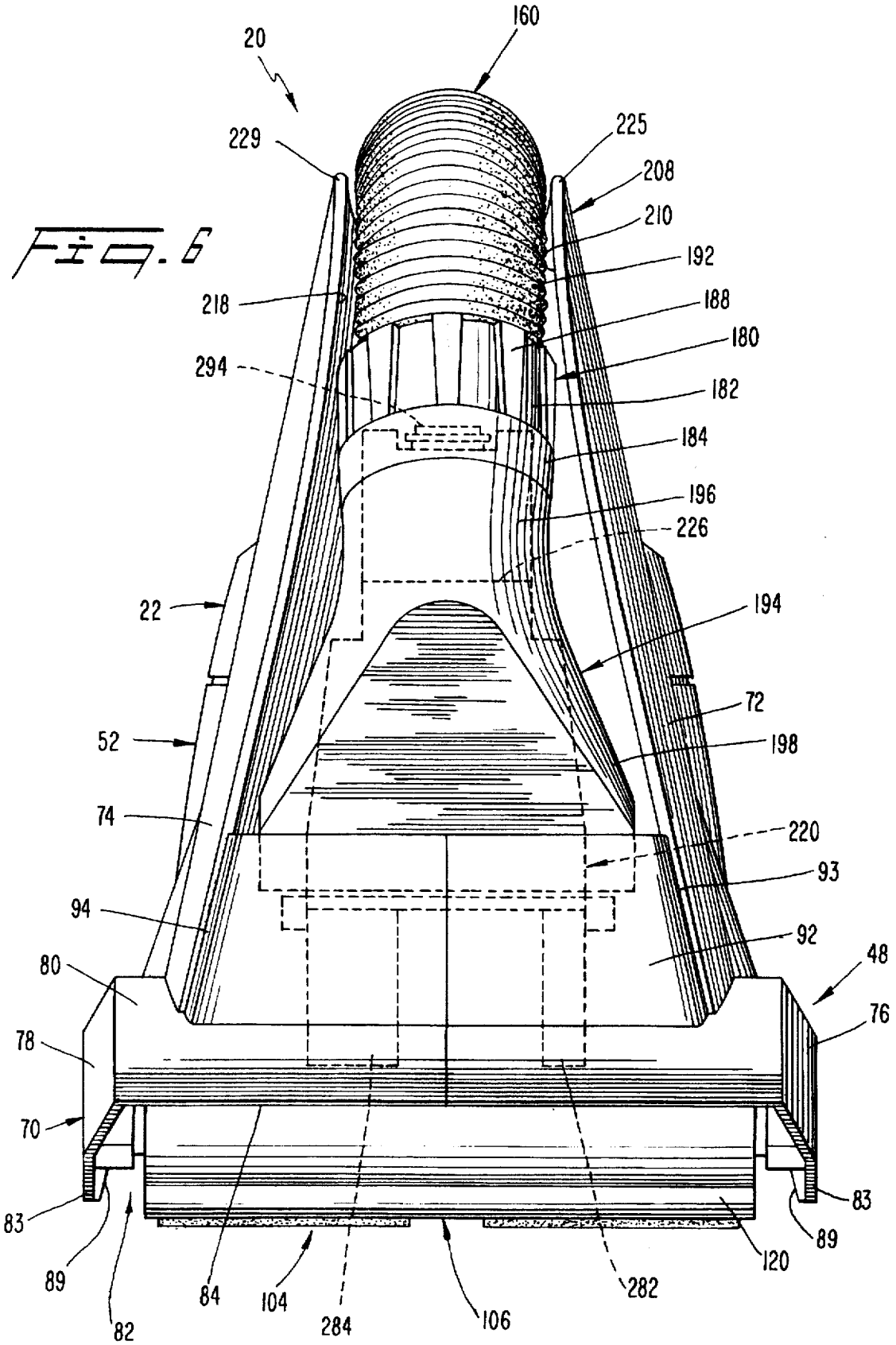
FIG. 6 is a front view of the vacuum cleaner of FIG. 1 showing a crevice tool coupled to the hose and in assembly with a housing of a brush compartment at a forward end of the vacuum cleaner in accordance with certain principles of the invention.

As shown in FIGS. 3 and 6, brush compartment section 48 is formed by shroud 70 which extends to a forward portion of housing 22 and which is joined integrally with a pair of sidewalls 72 and 74 of clam shell sections 24 and 26, respectively. Sidewalls 72 and 74 define a linking neck section. Shroud 70 is formed with a pair of spaced sides 76 and 78 and a top 80 with portions extending between the sides, all of which are joined integrally to define a brush compartment 82 (FIG. 6) therein. As shown in FIGS. 1, 2, 12 and 15, top 80 of shroud 70 is circular and the sides 76 and 78 are formed with a central lobe 83 which is located at the lowest point of the sides. A forward edge 84 of top 80 forms a first stop surface and a rear edge 85 of the top forms a second stop surface. An opening 86 (FIG. 9) is formed in the lower portion of shroud 70 and extends between spaced sides 76 and 78 and between forward edge 84 and rear edge 85.

Figure 9:
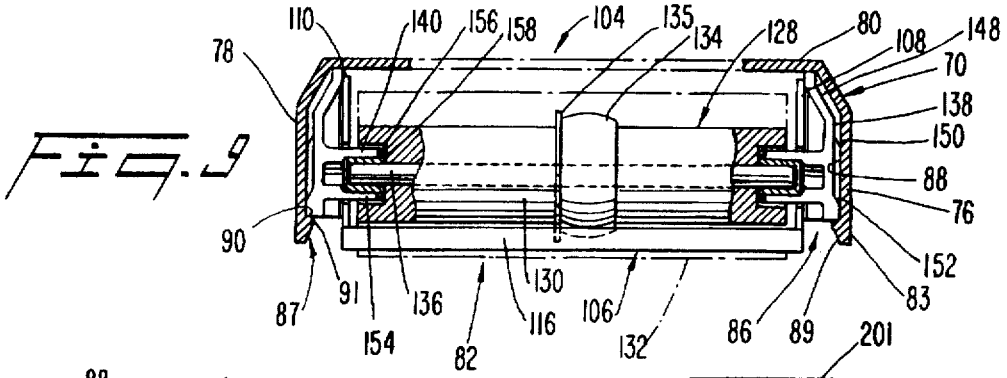
FIG. 9 is a sectional view showing the brush assembly in assembly within the brush compartment as illustrated partially in FIG. 8.
Figure 10:
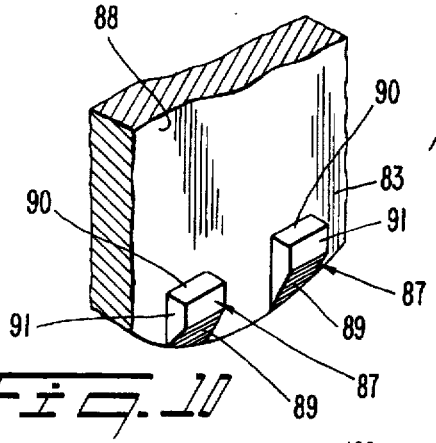
FIG. 10 is a partial perspective view of a portion of the brush compartment of FIG. 9 showing snap lugs formed on the housing of the brush compartment to facilitate the assembly of the brush assembly within the brush compartment in accordance with certain principles of the invention.

Referring to FIGS. 9 and 10, a pair of spaced snap lugs 87 are formed on the inside wall 88 of each lobe 83 with the lugs of one lobe facing the lugs of the other lobe. Each of the lugs 87 are formed with a sloped ramp 89 which slopes outwardly and upwardly from the bottom of inside wall 88. Each lug 87 is further formed with a ledge 90 which is above ramp 89 and perpendicular to inside wall 88. A transitional surface 91 is formed between sloped ramp 89 and ledge 90 and is parallel to inside wall 88.

As shown in FIGS. 2, 3, 6, 12 and 15, a front wall 92 and adjoining spaced sidewalls 93 and 94 extend upwardly from top 80 of shroud 70 and, together with a separator wall 96 (FIGS. 12 and 15), define an upper chamber 98. Upper chamber 98 is open to, and in direct communication with, brush compartment 82 so that air may flow freely from the compartment to the chamber. Front wall 92 and sidewalls 93 and 94 continue upwardly from separator wall 96 to form receptacle 100 for receipt of crevice tool 194 as described below. Separator wall 96 is formed with an opening 102 (FIGS. 12 and 15) which allows receptacle 100 to communicate with chamber 98 and, thereby, with brush compartment 82.

Figure 7:
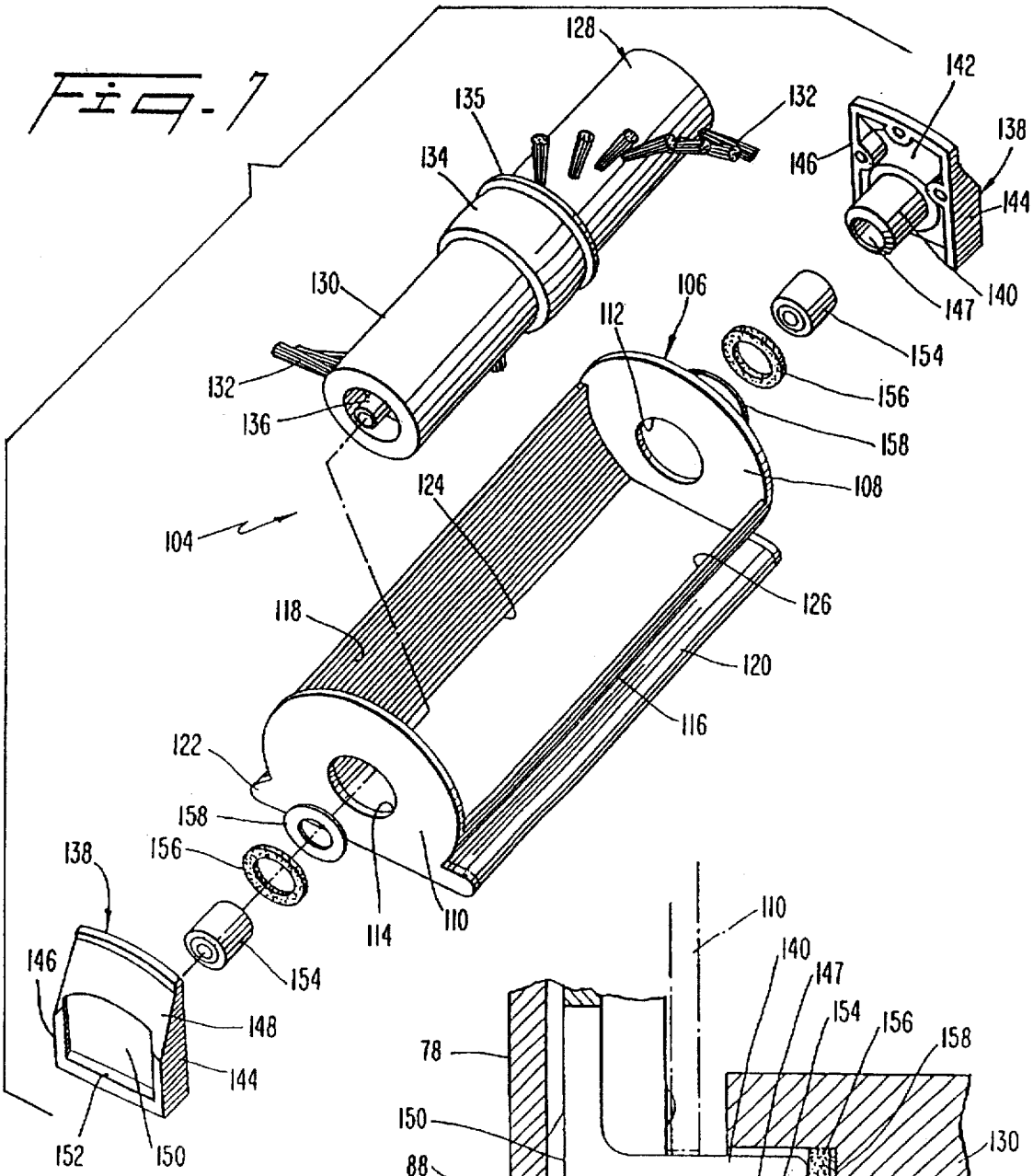
FIG. 7 is an exploded view showing a brush assembly of the vacuum cleaner of FIG. 1 in accordance with certain principles of the invention.

As shown in FIG. 7, brush assembly 104 includes a brush cover 106. Cover 106 is formed by a pair of spaced end walls 108 and 110 each of which has a flat edge along the base thereof but is formed with a generally circular edge otherwise. Walls 108 and 110 are formed with axial holes 112 and 114, respectively. Cover 106 further includes a pair of curved sidewalls 116 and 118 which extend between, and are integrally joined with, end walls 108 and 110. A first ledge 120 extends laterally outwardly in a first direction from one side of the base of brush assembly 104. A second ledge 122 extends laterally outwardly in a second direction, which is opposite from the first direction, from the opposite side of the base of brush assembly 104. The base of brush assembly 104 is formed with an opening 124 which extends between end walls 108 and 110. The-upper portion of brush assembly 104 is also formed with an opening 126 which also extends between end walls 108 and 110.

Figure 8:
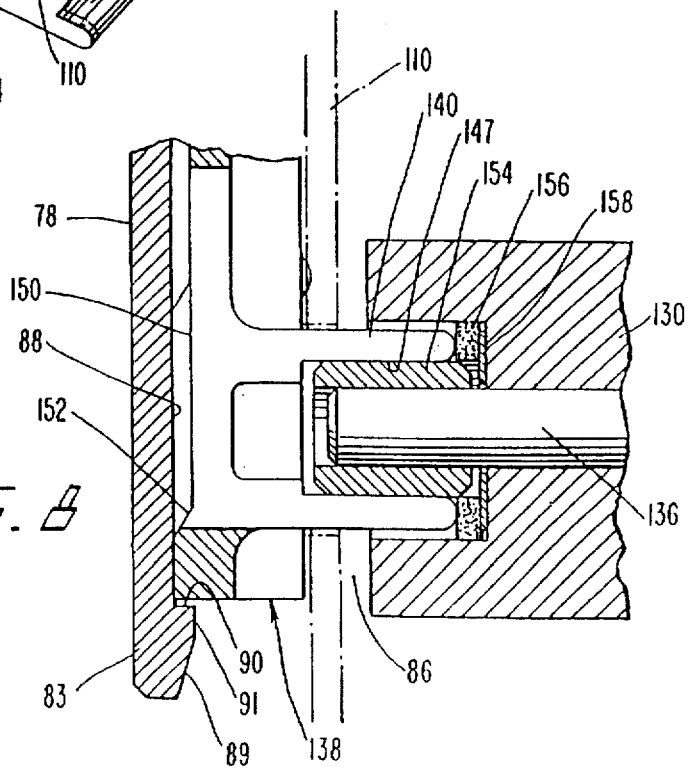
FIG. 8 is an enlarged partial view showing one end of the brush assembly of FIG. 7 in assembly with the housing of the brush compartment of FIG. 6 in accordance with certain principles of the invention.

Referring to FIGS. 7, 8 and 9, a brush 128 includes a support roller 130 with a plurality of bristles 132 extending radially from the periphery thereof. A belt pulley 134 is located about a central portion of the periphery of roller 130. Pulley 134 is formed with a shoulder 135 along one edge thereof to prevent belt 34 from moving from engagement with the pulley in the direction of the shoulder during operation of the vacuum cleaner 20. An axle 136 (FIG. 9) is attached to and extends axially from opposite ends of roller 130 for rotation with the roller.

A pair of identical end caps 138 are each formed with a tubular projection 140 which extends inwardly from an inside wall 142 located in a recess formed by a two spaced sidewalls 144 and 146. Each projection 140 is formed with an opening 147. The exterior of each end cap 138 is formed with a slanted upper surface 148, a vertical wall 150 and a slanted lower surface 152. Brush assembly 104 further includes a pair of bronze bushings 154, a pair of felt washers 156 and a pair of stainless steel washers 158.

Referring to FIGS. 7, 8 and 9, when assembling the components of brush assembly 104, roller 130 is positioned through opening 126 of brush cover 106 and is located between end walls 108 and 110 so that axles 136 are axially aligned with holes 112 and 114. Steel washers 158 are inserted over opposite ends of axle 136 and one of the bushings 154 is positioned over each end of the axle. The felt washers 156 are thereafter inserted over axles 136. Bushings 154 are inserted into openings 147 of end cap projections 140 such that the outboard ends of the bushings extend outwardly from the respective openings. The ends of axle 136 are then inserted into bushings 154 and the end faces of the projections 140 are pressed snugly against felt washers 156 to complete the assembly of the brush assembly.

As shown in FIG. 9, brush assembly 104 is assembled within brush compartment 82 by inserting the assembly into opening 86 of shroud 70. As assembly 104 is inserted through opening 86, slanted upper surface 148 and vertical wall 150 of each end cap 138 clears the adjacent inside walls 88 and snap lugs 87. Eventually, slanted lower surface 152 of each end cap 138 engages the sloped ramps 89 of the adjacent snap lugs 87 on lobes 83 at each of the sides 76 and 78. As slanted surfaces 152 move over ramps 89, lobes 83 and sides 76 and 78 are flexed outwardly to allow the passage of brush assembly 104 into brush compartment 82. Lower portions of end caps 138 glide past transitional surfaces 91 whereafter the lower portions of the end caps clear snap lugs 87 and the bottom of the end caps rest on ledges 90 of the snap lugs as illustrated in FIG. 8 and 9.

Figure 18:
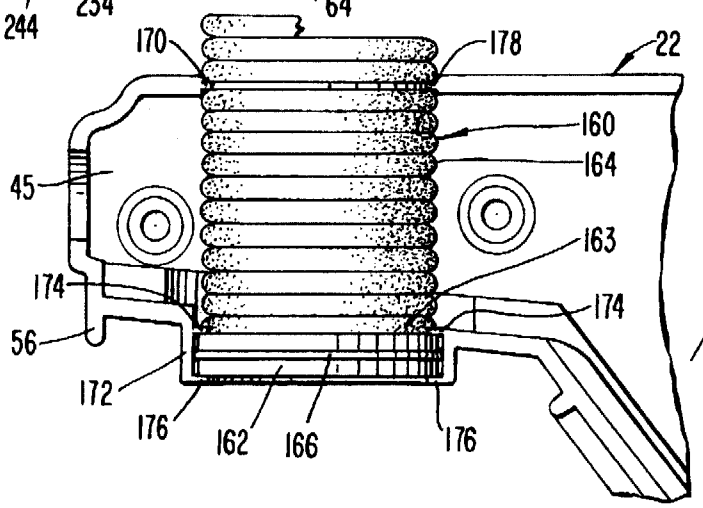
FIG. 18 is an enlarged partial view of FIG. 15 showing the manner of assembling the hose of FIG. 2 with the housing in accordance with certain principles of the invention.

Referring to FIGS. 15 and 18, vacuum cleaner 20 includes flexible hose 160 which is formed by a helical wire (not shown) covered by a stretchable non-metallic covering. A stretchable rubber band 162 is placed over an end portion 163 of a trailing end 164 of hose 160. Band 162 is formed with a compressible annular rib 166 which extends radially outwardly.

When assembling trailing end 164 of hose 160 within housing 22, clam shell sections 24 and 26 are separated to reveal the inner portions of section 24 as illustrated in FIGS. 15 and 18. Band 162 is inserted laterally into a semi-circular retainer 172 formed within section 24 in a pocket-like fashion. Retainer 172 is formed with spaced upper and lower lips 174 and 176, respectively, which extend inwardly toward the axis of the retainer to preclude axial movement of band 162 and end portion 163 of the hose 160. Section 26 is formed with a semi-circular retainer generally the same as retainer 172 so that, when sections 24 and 26 are assembled to form housing 22, a full circular retainer is formed to compress rib 166 and essentially capture band 162 and thereby end portion 163 of hose 160.

It is noted that retainer 172 is located above, and is in communication with, dust collection chamber 47 as defined by dust cup 52. In this manner, end portion 163 of hose 160 is also in communication with dust collection chamber 47 while retainer 172 and band 162 assist in retaining trailing end 164 of hose 160 with housing 22.

As shown in FIG. 3, housing 22 is formed with an opening 168. The portion of opening 168 which is formed by clam shell section 24 has a radius which is less than the radius of the portion of the opening which is formed by clam shell section 26. In effect, this provides a rib 170 (FIGS. 3 and 15) which is formed around one-half of opening 168 and which extends radially inwardly as shown in FIGS. 3 and 15. It is noted that the portion of opening 168 which is formed by section 26 with the larger radius is the same as the radius associated with the outside diameter of hose 160. Further, the radius of the portion of opening 168 which is formed by rib 170 of section 24 is less than the radius associated with the outside diameter of hose 160.

Referring to FIGS. 15 and 18, a section of the trailing end 164 of hose 160 is stretched slightly to spread adjacent convolutions of the helical wire and form a slight space 178 therebetween. Hose 160 is then manipulated to slide space 178 into the portion of opening 168 (FIG. 3) of shell section 24 whereby rib 170 is located within space 178. When shell sections 24 and 26 are assembled, hose 160 is captured in the position with rib 170 being located within space 178 whereby the hose is precluded from moving axially with respect to opening 168 and housing 22. In this manner, trailing end 164 of hose 160 is further secured to housing 22.

Figure 12:
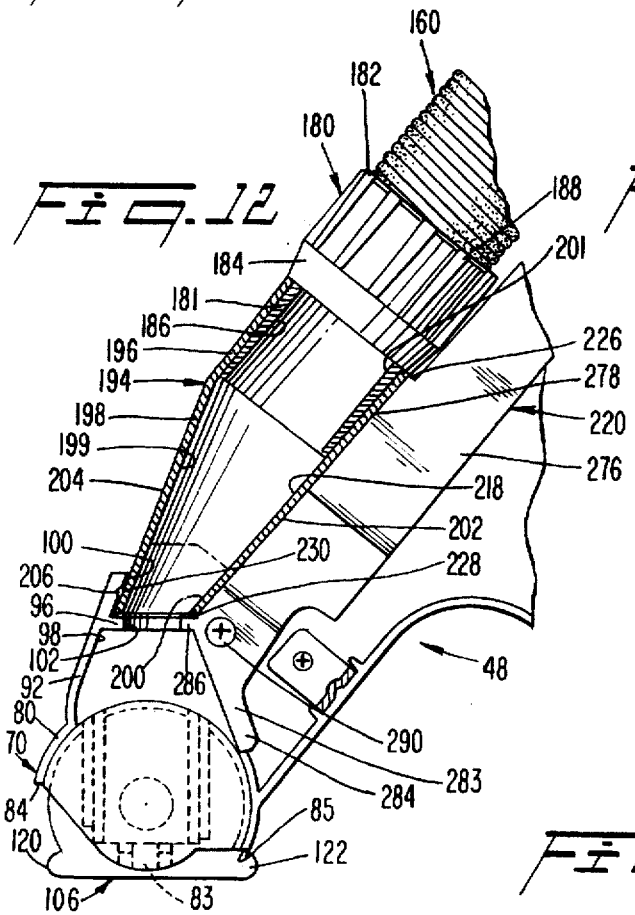
FIG. 12 is a partial sectional view showing the crevice tool in assembly with the housing of the brush compartment and retained therein by the retainer beads of FIG. 11 being located in complementary dimples in the housing in accordance with certain principles of the invention.

Referring to FIGS. 12 and 22, a hose connector or coupler 180 is formed in a generally tubular configuration having an opening 181 therethrough. Hose connector 180 is formed with a hose connection section 182, a tapered transition section 184 and a tool connection section 186. A plurality of axially aligned, spaced ribs 188 are formed on the exterior of hose connection section 182. Tool connection section 186 is formed with an outside diameter which is smaller than the diameter of tapered section 184 at the juncture of the tool connection section and the tapered section to form a shoulder 190. Tool connection section 186 is generally cylindrical and is tapered inwardly in the axial direction along both the outer and inner surfaces such that the thickness of the wall thereof is less at the outboard end of the section than at the inboard end thereof. Opening 181 is formed with threads 191 along a portion within hose connection section 182 and tapered section 184 at a pitch consistent with a pitch formed by the helix of the convolutions of hose 160.

To assemble hose 160 with hose connector 180, a forward end 192 of the hose is inserted into opening 181 of the connector and the connector is rotated to move spaces between convolutions of the hose into threaded engagement with threads 191 of the connector and thereby facilitate a threaded coupling between the connector and the hose.

Figure 11:
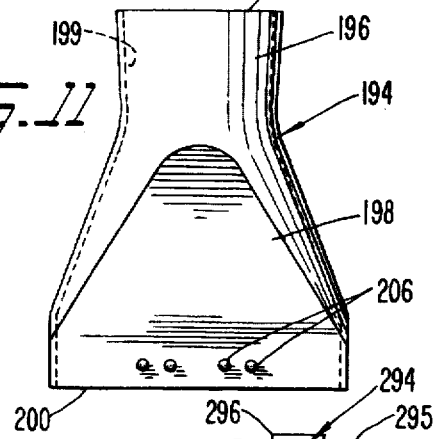
FIG. 11 is a top view of the crevice tool of FIG. 6 showing retainer beads which facilitate retention of the tool with the housing of the brush compartment in accordance with certain principles of the invention.

As shown in FIGS. 6, 11 and 12, crevice tool 194 is formed with a generally cylindrical section 196 and a wand section 198 with an opening 199 (FIGS. 12 and 13) formed therethrough and having an entry end 200 and an exit end 201. Section 196 flares slightly outwardly in a conical fashion from its inboard end to its outboard end to form a slight outward taper which is consistent with the exterior taper of tool connection section 186 of hose connector 180. Wand section 198 spreads laterally from its transition with cylindrical section 196 and assumes a generally flat configuration with a flat undersurface 202 and a tapered outer surface 204. A plurality of retainer beads 206 are formed on the tapered outer surface 204 near the outboard end thereof.

Crevice tool 194 is assembled with tool connection section 186 of hose connector 180 by positioning exit end 201 of opening 199 over the tool connection section. The interfacing tapered surfaces of opening 199 and tool connection section 186 provide for a press fit between crevice tool 194 and hose connector 180 whereby exit end 201 is positioned adjacent shoulder 190 but is not in engagement with the shoulder. In this manner, a continuous passageway is provided from entry end 200 of crevice tool opening 199, through crevice tool 194, hose connector 180, hose 160 and into dust collection chamber 47 (FIG. 15) defined by the inner walls of dust cup 52.

As shown in FIG. 1, support section 50 of vacuum cleaner 20 includes handle 208 which extends in an arcing fashion from the top rear of body section 46 adjacent opening (FIG. 3) 168 to a forward portion of the body section and includes opening 209 as noted above. Handle 208 is formed with channel 210 (FIG. 4) in a "U " shaped cross-sectional configuration as noted above which opens generally upwardly. As shown in FIGS. 1, 3, 4 and 6, a forward portion of channel 210 blends with a pair of concave transition surfaces 212 and 214. Surface 214 blends with flat section 216 which extends to receptacle 100 (FIG. 12) which, as noted above, is located at an upper portion of brush compartment section 48. A major portion of flat section 216 is formed by a flat outer surface 218 of a belt access cover such as an access panel 220. The remaining portion of flat section 216 is formed by flat surfaces 222 and 224 of housing 22 on each planar side of flat outer surface of panel 222. Panel 222 is formed with a step or shoulder 226 (FIG. 12) at a location intermediate the ends thereof.

Channel 210 and surfaces 212 and 214 form a cradle having opposed side rails 225 and 229 (FIGS. 2 through 6) for receiving hose 160 therein as illustrated in FIGS. 1 and 15. Flat section 216 which forms a body section channel, forms a continuation of the cradle for receiving hose connector 180 and the flat undersurface 202 of crevice tool 194 when the forward end of wand section 198 of the tool is inserted into receptacle 100 as shown in FIG. 12. Also, side rails 225 and 229 continue along opposite sides of flat section 216 and extend to the juncture of the flat section with receptacle 100 (FIG. 3). As shown in FIGS. 12 and 15, shoulder 226 is located adjacent hose connector 180 to provide sufficient depth in flat section 216 to accommodate the transition from the larger diameter portion of the connector to the smaller diameter of the cylindrical section 196 of crevice tool 194. It is noted that, as shown in FIGS. 2 and 3, a pair of ribs 227 are formed at opposite sides of receptacle 100 to define the width of the receptacle and to guide crevice tool 194 properly into the receptacle.

As shown in FIG. 12, a seal 228 is placed on top of separator wall 96 and surrounds the perimeter of opening 102 which conforms generally to the shape of opening 199 at entry end 200 of crevice tool 194. When the forward end of crevice tool 194 is inserted into receptacle 100, the forward end of the tool engages and compresses seal 228 to essentially form an airtight seal at this juncture. In addition, when the forward end of crevice tool 194 is inserted into receptacle 100, retainer beads 206 of the tool engage and seat in complementary dimples 230 formed in the inside surface of the upper portion of front wall 92 which forms the front wall of receptacle 100. When beads 206 seat in dimples 230, crevice tool 194 is thereby releasably retained in assembly with receptacle 100.

Figure 17:
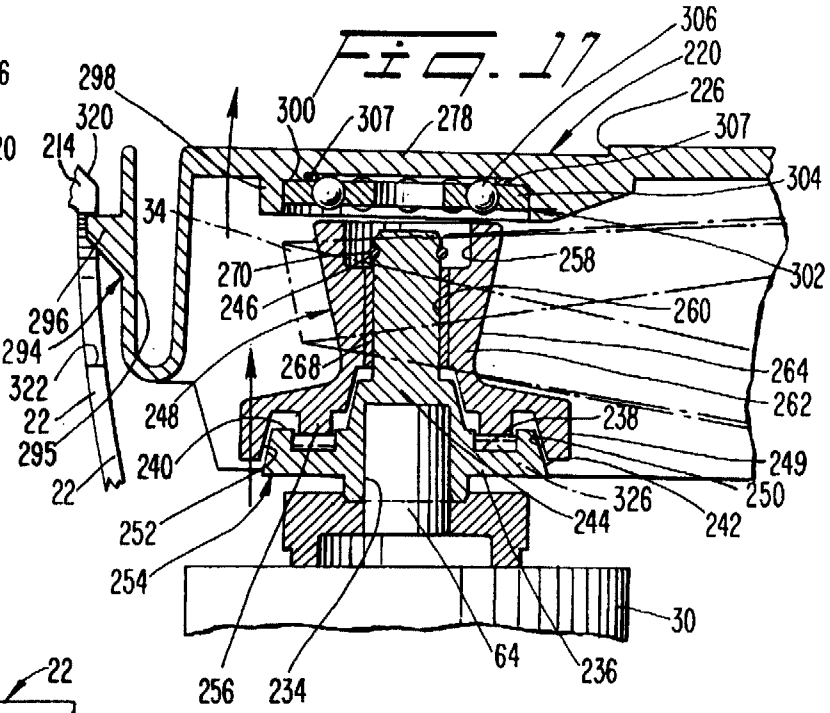
FIG. 17 is a partial side view of the components of FIG. 16 with the crevice tool and adjacent portion of the hose detached from the housing during operation in a hose mode in accordance with certain principles of the invention.
Figure 16:
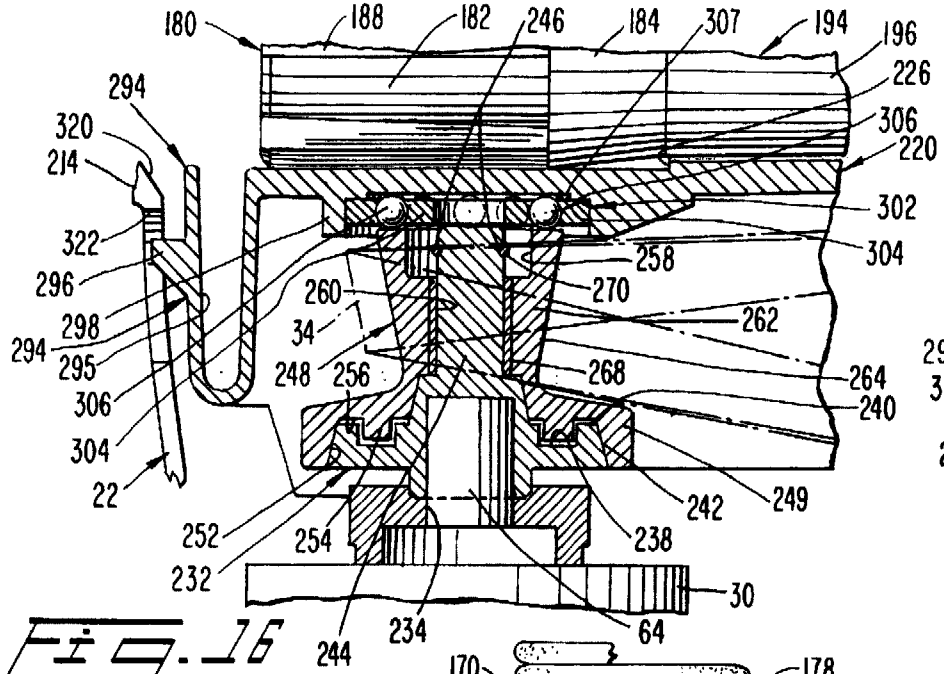
FIG. 16 is a partial side view of a motor shaft, clutch hub, belt pulley, ball bearing, the access panel of FIG. 15 and the crevice tool and hose in assembly with the housing during operation of the brush in a brush mode in accordance with certain principles of the invention.

As viewed in FIGS. 15, 16 and 17, one-piece clutch hub 232 is formed with an axial opening 234 at the base thereof, a radially extending flange 236 and a circular groove 238 formed in an upper surface 240 of the flange. Hub 232 also includes a tapered surface 242 formed on the periphery of flange 236, a stem 244 extending axially upwardly from the flange and an annular groove 246 formed in the stem at the top thereof. A one-piece belt pulley 248 is formed with a flange 249 at the base thereof. Flange 249 is formed in the base thereof with a recess 250 having a tapered sidewall 252. A circular ring-like projection 254 is formed in and extends downwardly from a ceiling 256 of recess 250. Pulley 248 is further formed with an opening 258 at the top thereof and a narrow intermediate opening 260 which is in communication with recess 250 at the bottom thereof and in communication with opening 258 at the top thereof. A belt-engaging pulley hub 262 extends upwardly from flange 249 and is formed with a sidewall 264 which tapers outwardly from its juncture with the flange to the free end thereof.

In assembly, opening 234 of hub 232 is positioned over shaft 64 which extends from motor 30 and the hub is press fit onto the shaft. A bushing 268 is press fit into intermediate opening 260 of pulley 248. Stem 244 of hub 232 is moved into the opening of bushing 268 to the extent that groove 246 and the free end of the stem are located in opening 258 of pulley 248. A wire spring clip 270 is inserted into groove 246 to facilitate retention of hub 232 with pulley 248. Drive belt 34 is positioned over and in engagement with tapered sidewall 264 of pulley 248. In this arrangement, tapered surface 242 of hub 232 is located adjacent to tapered sidewall 252 of pulley 248 for eventual frictional engagement therebetween, in the manner described below, to provide a drive coupling between the hub and the pulley and thereby to drive belt 34. It is noted that circular projection 254 of pulley 248 is located in circular groove 238 of clutch hub 232 but there is no engagement of any surface of the projection with any surface of the groove for a purpose to be described below.

Figure 13:
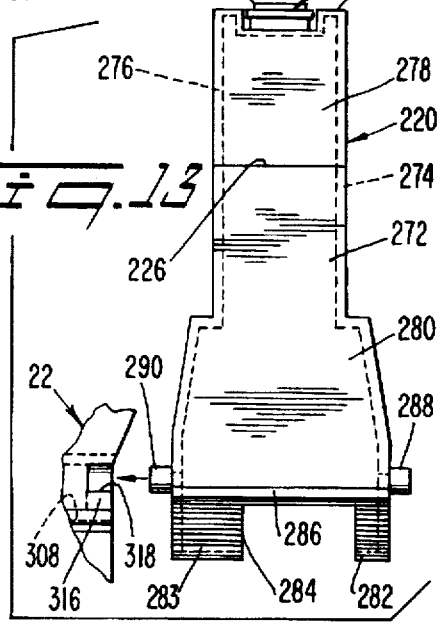
FIG. 13 is a top view of the disassembled access panel in position for assembly of retainer lugs thereof with the accommodating structure of the housing of the vacuum cleaner in accordance with certain principles of the invention.

Referring to FIGS. 13 and 15, belt access panel 220 is formed with an upper wall 272 and a pair of opposed sidewalls 274 and 276, each of which are contiguous with, and extend at a right angle from, opposite side edges of the upper wall of the panel. As shown in FIG. 13, upper wall 272 includes a generally rectangular portion 278 which extends from the top thereof to an intermediate section. The upper wall 272 expands on each side at the intermediate section to form a widened portion 280 which extends to a location near the lower end of the upper wall. A pair of lower portions 282 and 283 extend forwardly from wall 272 and are angled downwardly in the same plane with an intermediate opening 284 formed therebetween as shown in FIG. 13. A projecting wall 286 of panel 220 extends angularly from a bend in upper wall 272 at the juncture of widened portion 280 and lower portions 282 and 283. A pair of pivot lugs 288 and 290 extend from sidewalls 274 and 276, respectively, adjacent opposite ends of projecting wall 286.

At the top of upper wall 272, a laterally intermediate portion of the wall is folded on itself as shown in FIGS. 15, 16 and 17 to form a latch 294 which includes a folded section 295 and a latching rib 296 extending upwardly therefrom. Section 295 is formed perpendicular to the plane of flat panel portion 278 and the section is folded on itself as noted above. With section 295 folded on itself, the section provides resiliency for rib 296 such that the rib is biased to extend normally to the left of the left edge of panel portion 278 as viewed in FIGS. 16 and 17. As further shown in FIGS. 15, 16 and 17, a circular wall 298 is formed on an underside surface of rectangular portion 278 of upper wall 272 and extends inwardly of vacuum cleaner 20 toward belt pulley 248. Circular wall 298 forms a pocket 300 for receipt of a steel washer 307 and a ball bearing 302 which is press fit into the pocket. Ball bearing 302 is formed by a circular housing 304 which supports and captures a plurality free floating balls 306 which are radially and spatially arranged in a circle about the axis of the circular housing. The upper surfaces of balls 306, as illustrated in FIGS. 16 and 17, engage an adjacent surface of washer 307 so that the balls will roll on the washer instead of the base surface of pocket 300. While balls 306 are captured within housing 304, portions of each of the balls extend beyond each side of the housing and the balls are allowed to roll freely within their confined positions within the housing.

Figure 14:
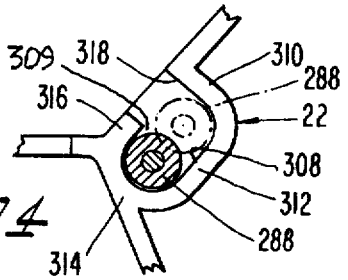
FIG. 14 is a partial view of the accommodating structure of the housing of the vacuum cleaner of FIG. 1 with the retainer lugs of the access panel of FIG. 16 in assembly therewith in accordance with certain principles of the invention.

Referring to FIGS. 13, 14 and 15, a pair of spaced lugreceptacle chambers 308 (one shown) are formed in housing 22 in an area just above opposite ends of upper chamber 98 (FIG. 15) and inboard of opposite ends of receptacle 100. As shown in FIG. 14, each of the chambers 308 is enclosed by three walls 310, 312 and 314 and partially by a fourth wall 316. Fourth wall 316 of each chamber 308 is formed with a passage or opening 318 which allows lateral access to a first portion of the chamber which is in communication with a second portion of the chamber. Each of the chambers 308 is formed with an open top 309 which exposes the first and second portions of the chamber.

When assembling belt access panel 220 with housing 22, the panel is manipulated to align pivot lugs 288 and 290 with openings 318 as represented in FIG. 13. Panel 220 is then moved to move lugs 288 and 290 through openings 318 into the first portion of the respective chambers 308 to a position represented by the dashed circle in FIG. 14. Panel 220 is then moved slightly downwardly, and by virtue of open top 309 of the respective chambers 308, lugs 288 and 290 are allowed to move to the second portion of the respective chambers to the position represented by the solid circle in FIG. 14. Panel 220 is then pivoted inwardly about an axis of lugs 288 and 290 whereby latch rib 296 engages a lower edge 320 (FIGS. 13, 14, 15 and 16) of transition surface 214 such that the rib is depressed inwardly from its biased position and allowed to move inboard of housing 22. Eventually, rib 296 clears edge 320 of transition surface 214 and snaps biasingly into a latch opening 322 formed in housing 22 inboard of the edge of the transition surface whereby panel 220 is removably retained with the housing.

As shown in FIG. 15, when panel 220 is fully assembled with housing 22, lower portions 282 and 283 (FIG. 13) of the panel provide an inboard wall for upper chamber 98 while opening 284 provides a passage for belt 34. Further, wall 286 is located in the plane of separator wall 96 on the inboard side of opening 102 to assist in the defining of the opening and to assist in providing separation between upper chamber 98 and receptacle 100.

When assembling belt 34 with vacuum cleaner 20, crevice tool 194 is withdrawn from receptacle 100 in the event that it is in assembly with the receptacle. Referring to FIG. 17, access panel 220 is removed by depressing folded section 295 of latch 294 by use of an implement such as, for example, the flat bit of a screw driver (not shown). As the folded section 295 is depressed, rib 296 clears opening 322 and panel 220 can be pivoted outwardly about the axis of lugs 288 and 290. Panel 220 can then be removed from assembly with housing 22 by withdrawing lugs 288 and 290 from chambers 308 in a manner reverse to that described above with respect to the assembly of the panel with the housing. Existing belt 34 is withdrawn from its position about hub 262 of pulley 248 in the event the belt is in the assembled position. Brush assembly 104 is then withdrawn from brush compartment 82 by initially flexing outwardly either or both of lobes 83 so that the bottom surface of one or both end caps 138 clears the associated ledge 90 and the brush assembly is free to be extracted from the brush compartment. Thereafter, the components of brush assembly 104 are dismantled in an order reverse of the order in which they were assembled as described above to allow the removal of brush roller 130 from brush cover 106. Existing belt 34 is then withdrawn from brush roller 130. New belt 34 is then looped over roller 130 and positioned about pulley 134 and the roller and other components of brush assembly 104 are reassembled in the manner described above.

New belt 34 is now gripped through the opening in flat section 216 (FIG. 3) provided by the previous removal of access panel 220 and the belt is stretched upwardly and placed over pulley hub 262. Access panel 220, with ball bearing 302 assembled in pocket 300, is reassembled with housing 22 in the manner described above. With dust cup 52 and dust collector 40 having been assembled in the manner as described above, vacuum cleaner 20 is now ready for preparation for use in either a brush mode or a hose mode.

When using vacuum cleaner 20 in the brush mode, hose 160 is placed in channel 210 and hose connector 180 and crevice tool 194 are placed on flat section 216 with the forward end of the tool being located in receptacle 100. As the forward end of crevice tool 194 is placed into receptacle 100, beads 206 locate in dimples 230 as described above to retain the tool within the receptacle. When the forward end of crevice tool 194 is assembled in receptacle 100 and the tool rests on access panel 220, the forward end of the tool mates with the walls of the receptacle in such a manner that flat undersurface 202 of the tool and portions of hose connector 180 exert an inwardly directed pressure or force against the panel. As the inwardly directed force is applied against access panel 220, the panel moves slightly inwardly as shown in FIGS. 15 and 16 whereby balls 306 of ball bearing 302 are pressed against the outer face of pulley hub 262. As balls 306 are pressed against pulley hub 262, pulley 248 is moved toward clutch hub 232 whereby tapered surface 242 of the clutch hub frictionally engages tapered sidewall 252 of pulley 248. Thereafter, upon driving rotation of shaft 64 by motor 30, belt 34 is driven to rotate brush 128 and thereby to operate vacuum cleaner 20 in the brush mode. During operation of vacuum cleaner 20 in the brush mode, balls 306 of ball bearing 302 continue to press against belt pulley 248 whereby the balls are allowed to rotate within their confinement in housing 304 as the pulley is rotated. In this manner, a continuous force is applied against pulley 248 to sustain the frictional and driving engagement between the pulley and clutch hub 232.

During the brush mode of operation, brush cover 106 can be rotated between the limits of ledge 120 of the brush cover engaging forward edge 84 of shroud 70 and ledge 122 of the brush cover engaging rear edge 85 of the shroud as shown in FIG. 15. This versatility in positioning of the brush cover 106 allows the user of vacuum cleaner 20 to move brush 128 over surfaces to be cleaned where the topography of such surfaces include various inclines and valleys. The ability to rotate brush cover 106, as noted above, allows the surfaces to be cleaned without any significant need for adjusting the desired angle at which the entire vacuum cleaner 20 is being held at various stages of the cleaning process.

During the process of using vacuum cleaner 20 in the brush mode, motor 30 is rotating fan 38 to create a suction in brush compartment 82 and at the area of contact by bristles 132 with the surface being cleaned. The suction created by fan 38 results in the drawing of dirt-laden air, including dirt, dust and debris, directly from the surface being cleaned and from the disturbance created by bristles 132 passing over and into the surface. The dirt-laden air is then drawn through brush compartment 82, upper chamber 98, crevice tool 194, hose 160 and into dust collection chamber 47. While the air continues to be drawn by fan 38 in the direction of the fan, the dirt, dust and debris is prevented from being drawn any further due to the filtering property of dust collector 40 and the dirt, dust and debris remains, and is collected, in chamber 47. The now- filtered air passes through fan 38 and is directed over and around motor 30 to cool the motor whereafter the air is passed through a plurality of louvers 324 (FIGS. 1 and 15) formed in clam shell sections 24 and 26 of housing 22.

Thus, it is noted that, in the brush mode, crevice tool 194 and hose 160 serve as a conduit for dirt-laden air collected through brush compartment 82.

During the brush mode of operation, hose 160 is seated in the cradle formed by channel 210 of handle 208. In this position and during the brush mode of operation, the upper half of hose 160 is fully exposed and provides a facility, and a surface in conjunction with handle 208, for firm manual gripping during manipulation and supporting of the vacuum cleaner 20 in the brush mode use thereof. Also, when the vacuum cleaner 20 is being transported and is not being used in either the brush mode or a hose mode, hose 160 in conjunction with handle 208 provides a surface for a firm manual gripping for transporting the vacuum cleaner.

When vacuum cleaner 20 is to be used in the hose mode, crevice tool 194 is removed from assembly with receptacle 100 and is moved away from flat section 216 and hose 160 is moved out of the cradle formed by channel 210. As crevice tool 194 is moved away from flat section 216, the pressure previously applied against access panel 220 by the crevice tool is removed whereby the panel is flexed outwardly. As panel 220 is flexed outwardly, balls 306 of ball bearing 302 move away from the outer face of pulley hub 262. This results in the removal of the force previously applied to pulley 248 by ball bearing 302. In the preferred embodiment of the invention, the tension on belt 34 as applied to belt pulley 248 then literally urges the pulley away from driving engagement with clutch hub 232. It is noted that the taper of pulley hub surface 264 enhances the tension of belt 34 on pulley 248 to the extent that the taper assists in facilitating belt-induced movement of the pulley away from clutch hub 232 when crevice tool 194 is moved away from flat section 216.

After preparing vacuum cleaner 20 for operation in the hose mode as noted above, switch 42 may be closed to operate motor 30. Since pulley 248 has disengaged from clutch hub 232, brush 128 will not be operated but fan 38 will be operated as described above to develop the vacuum necessary to draw dirt-laden air through crevice tool 194 and hose 160 and deposit it in chamber 47. In the hose mode, crevice tool 194 can be manipulated and extended a distance from housing 22 as determined by the stretch ability of hose 160 from its mounting at the trailing end 164 thereof with the housing.

In an alternate embodiment of the invention, a wave washer 326, shown in phantom view in FIG. 17, is placed in the space between the bottom surface of circular projection 254 of pulley 248 and the bottom surface of circular groove 238 of clutch hub 232. Wave washer 326 is circular as viewed from the top and, as viewed from the side, is formed with undulations in a normal undulating configuration. When wave washer 326 is subjected to compressing forces, the undulations thereof are compressed to store energy to allow the undulations to return to their normal undulating character when the compressive forces are lessened or removed. When ball bearing 302 is pressed into engagement with the outer surface of pulley hub 262, pulley 248 is moved into engagement with clutch hub 232 whereby wave washer 326 is compressed to some degree between the bottom surface of circular projection 254 and the bottom surface of circular groove 238. When ball bearing 302 is moved away from the outer surface of pulley hub 232 as described above in contemplation of operation in the hose mode, the energy stored in compressed wave washer 326 urges the washer to return to its normal undulating configuration. As washer 326 returns to its normal undulating configuration, the bottom surfaces of circular projection 254 and circular groove 238 are urged apart by the washer to thereby move pulley 248 from driving engagement with clutch hub 232. It is noted that wave washer 326 could be used as the sole source of urging belt pulley 248 away from clutch hub 232 or it could be used in conjunction with the tensioning of belt 34, as noted above, to move the pulley away from the clutch hub. In either instance, such action is accomplished without departing from the spirit and scope of the invention.

Other devices having operational characteristics similar to wave washer 326 could be used to accomplish disengagement between pulley 248 and clutch hub 232 without departing from the spirit and scope of the invention.

It is noted that, in the preferred embodiment of the invention, clam shell sections 24 and 26, fan 38, cup 52, hose 160, hose connector 180 and access panel 220 are composed of plastic. Also, all components of brush assembly 104, except for axle 136, bushing 154, felt washer 154 and stainless steel washer 158, are composed of plastic. Any or all of these plastic elements could be composed of materials other than plastic without departing from the spirit and scope of the invention.

In general, the above-identified embodiments are not to be construed as limiting the breadth of the present invention. Modifications, and other alternative constructions, will be apparent which are within the spirit and scope of the invention as defined in the appended claims.

What is claimed is:

1. In a housing for a hand-held vacuum cleaner, which comprises:

the housing formed with a forward end and a rearward end which are spaced from each other and spaced sides, the distance between the forward and rearward ends being greater than the distance between the sides;

the housing having a body section having a rear portion and sides which are coincidental with the rearward end and the sides, respectively, of the housing and a forward portion spaced from the rear portion in a direction toward and spaced rearwardly from the forward end of the housing;

a support section having a forward portion spaced rearwardly from the forward end of the housing, an intermediate portion joined with the body section and a rear portion adjacent the rearward end of the housing;

a linking neck section having a rear portion joined with the forward portion of the body section and the support section, and a forward portion of the linking neck section located adjacent the forward end of the housing;

the body section formed with a forward exterior surface spaced from and interfacing with a rearward exterior surface formed on the linking neck section;

a brush compartment section joined with the forward portion of the linking neck section and located at the forward end of the housing;

a handle forming a portion of the support section and extending from the rear portion of the body section toward the forward end of the housing to a juncture with the rear portion of the linking neck section; and the handle formed with a channel which faces outwardly in a direction away from the body section.

2. In the housing as set forth in claim 1 wherein the channel is a support section channel, which further comprises:

a body section channel formed in the body section and extending between the juncture and the forward portion of the body section; and the body section channel joined with the support section channel to form a continuous channel extending from the rear portion to the forward portion of the body section.

3. In the housing as set forth in claim 2, which further comprises:

the support section channel is formed in a concave configuration from the rear portion to the juncture.

4. In the housing as set forth in claim 2, which further comprises:

a receptacle formed in the housing in communication with the body section channel at the forward portion of the body section.

5. In the housing as set forth in claim 1, which further comprises:

the channel is formed in a concave configuration from the rear portion to the juncture.

6. In the housing as set forth in claim 1, which further comprises:

the handle being formed with a rear end and a forward end which are joined integrally with spaced portions of the body section; and an opening formed between the body section and a portion of the handle between the rear and forward ends thereof.

7. The vacuum cleaner as set fourth in claim 1, which comprises:

the housing having a receptacle formed therein and having at least one wall with an inner surface;

an implement having a forward end located in the receptacle with an outer surface of the implement being in facing engagement with the inner surface of the wall;

the implement being formed on the outer surface with a plurality of protrusions;

each of the plurality of protrusions being formed in a prescribed configuration; and the inner surface of the receptacle wall being formed with a corresponding plurality of depressions, each of which is formed in a configuration which is complementary to the prescribed configuration for receiving the protrusions of the implement upon assembly of the implement into the receptacle.

8. A hand-held vacuum cleaner, which comprises:

a housing formed with a forward end and a rearward end which are spaced from each other and spaced sides, the distance between the forward and rearward ends being greater than the distance between the sides;

the housing having a body section, a support section and a linking neck section;

the body section having a rear portion and sides which are coincidental with the rearward end and the sides, respectively, of the housing and a forward portion spaced from the rear portion in a direction toward and spaced rearwardly from the forward end of the housing;

the support section having a forward portion spaced rearwardly from the forward end of the housing, an intermediate portion joined with the body section and a rear portion adjacent the rearward end of the housing;

the linking neck section having a rear portion joined with the forward portion of the body section and the support section, and a forward portion of the linking neck section located adjacent the forward end of the housing;

the body section formed with a forward exterior surface spaced from and interfacing with a rearward exterior surface formed on the linking neck section;

a brush compartment section joined with the forward portion of the linking neck section and located at the forward end of the housing;

a handle forming a portion of the support section and extending from the rear portion of the body section toward the forward end of the housing to a juncture with the rear portion of the linking neck section; and the handle formed with a channel which faces outwardly in a direction away from the body section; and a hose extending from the rear portion of the body section at least to the juncture and being located in the channel.

9. The vacuum cleaner as set forth in claim 8, which further comprises:

the portion of the hose which is located in the channel, and the portion of the channel which has the hose located therein, each being formed with shapes which are complementary to each other.

10. The vacuum cleaner as set forth in claim 8, wherein the channel is a support section channel and which further comprises:

a body section channel formed in the body section and extending between the juncture and the forward portion of the body section; and the body section channel joined with the support section channel to form a continuous channel extending from the rear portion to the forward portion of the body section.

11. The vacuum cleaner as set forth in claim 10, which further comprises:

an implement coupled to the hose adjacent the juncture and located in the body section channel whereby the hose and the implement are located in the continuous channel.

12. The vacuum cleaner as set forth in claim 11, which further comprises:

an implement receptacle formed in the housing in communication with the body section channel at the forward portion of the body section; and a forward end of the implement, opposite the end which is coupled to the hose, being located in the implement receptacle.

13. The vacuum cleaner as set forth in claim 11, which further comprises:

a coupler for facilitating the coupling between the hose and the implement;

the coupler formed with an opening having threads therein of a prescribed pitch;

the hose formed with a first end and a second end and extending therebetween; and the hose formed in a helical configuration in the prescribed pitch from the first end to the second end thereof for threaded assembly with the coupler.

* * * * *